United States Patent [19]

Yamaguchi et al.

[11] Patent Number: 4,928,965

[45] Date of Patent: May 29, 1990

[54] GOLF CLUB AND METHOD OF DESIGNING SAME

[75] Inventors: Tetsuo Yamaguchi; Hiroomi Matsushita, both of Kobe, Japan

[73] Assignee: Sumitomo Rubber Industries, Ltd., Kobe, Japan

[21] Appl. No.: 181,523

[22] Filed: Apr. 14, 1988

Related U.S. Application Data

[63] Continuation-in-part of Ser. No. 753,624, Jul. 10, 1985, abandoned.

[30] Foreign Application Priority Data

Jul. 10, 1984 [JP] Japan ..... 59-143429
Jun. 12, 1985 [JP] Japan ..... 60-127752

[51] Int. Cl.[5] ..... A63B 53/04

[52] U.S. Cl. ..... 273/78; 273/DIG. 22; 273/167 H; 273/173; 273/76; 273/73 E; 273/72 R

[58] Field of Search ..... 273/DIG. 22, 173, 78, 273/167 H, 174, 76, 73 E, 72 R, 169, 167 A

[56] References Cited

U.S. PATENT DOCUMENTS

| | | | |
|---|---|---|---|
| 3,945,646 | 3/1976 | Hammond | 273/186 A |
| 4,070,022 | 1/1978 | Braly | 273/77 A |
| 4,291,574 | 9/1981 | Frolow | 273/73 H X |
| 4,792,140 | 12/1988 | Yamaguchi et al. | 273/DIG. 22 |
| 4,809,978 | 3/1989 | Yamaguchi et al. | 273/DIG. 22 |

FOREIGN PATENT DOCUMENTS

| | | |
|---|---|---|
| 0176021 | 9/1985 | European Pat. Off. . |
| 2056288 | 3/1981 | United Kingdom . |
| 2124910 | 2/1984 | United Kingdom . |

OTHER PUBLICATIONS

Engineering Vibration Research by Kenji Nakagawa et al., Mar. 25 1976, pp. 41–42.

*Primary Examiner*—George J. Marlo

[57] ABSTRACT

A golf club comprising a club head having a mechanical impedance with a primary minimum value in a region of frequency in which the mechanical impedance of a ball to be struck takes a primary minimum value. Mechanical impedance is defined as the ratio of an external force applied to one point of the ball (or the club head) over the response speed of another point of the ball (or the head) when the force is applied.

18 Claims, 7 Drawing Sheets

GOLF CLUB AND METHOD OF DESIGNING SAME

PRIOR APPLICATION DATA

This is a continuation-in-part application of our copending application Ser. No. 753,624, filed on July 10, 1985, now abandoned.

BACKGROUND OF THE INVENTION

1. Field of the Invention

This invention relates to a golf club, and more particularly to a golf club which is improved to provide a longer travelling distance for a struck ball.

Specifically, the invention is applicable to any wood or iron clubs which are intended to provide a reasonable or considerable travelling distance of a hit ball. Thus, the invention is not applicable to putters which are designed to control the direction for a rolling ball and to improve the feeling of putting.

2. Description of the Prior Art

In golf, clubs are used as ball striking instruments. As is well known, the travelling distance of a struck ball is determined by the action of the golf club which governs the trajectory and initial speed of the ball. More specifically, the trajectory of the struck ball is influenced by the spin, trajectory angle and direction of the ball imparted by the club, while the initial ball speed is influenced by the club head speed and the coefficient of restitution.

Among these factors, the spin, trajectory angle and travelling direction of a struck ball are explained from the view point of dynamics with emphasis placed on the moment of inertia around the center of gravity of the club head. The speed of the club head is explained in relation to swing of the club with emphasis placed on the club shaft.

However, the coefficient of restitution involves the problem of the relationship between the golf ball and the golf club. Little has hitherto been described about the influences on the coefficient of restitution exerted when the club (head) strikes the ball.

Conventional golf clubs generally have heads made of persimmon wood (possibly with an ABS plastics insert of less than 8 mm in thickness), carbon-fiber-reinforced plastics (CFRP), aluminum, or stainless steel. A conventional view on the component materials is such that the harder the material, the greater the impact resilience to a golf ball (larger coefficient of restitution). Thus, the conventional view holds that harder materials will make the ball travel further or at a greater initial speed. Therefore, in the case of using carbon-fiber-reinforced plastics (CFRP) for example, a higher fiber content is believed preferable because of increased hardness and presumably increased coefficcient of restitution.

SUMMARY OF THE INVENTION

The present invention is based on a finding that this conventional view is incorrect. After repeated experiments conducted over the years, it has been found that there is an appropriate degree of hardness for a club head which provides the largest impact resiliency and the highest initial speed for the struck ball. However, an excessive hardness beyond this appropriate degree reduces the impact resiliency of the ball. Further, the invention has disclosed that mechanical impedances of a ball and a club (particularly club head) exert influences upon the impact resiliency of the ball.

An object of the invention is to provide a golf club which produces an increased impact resiliency when striking a ball and increases the the initial speed of the ball to a maximum extent, thereby causing the ball to travel over a long distance.

Another object of the invention is to make it possible to easily design a golf club having a large coefficient of restitution.

Other objects, features and advantages of the invention will become apparent from the detailed description given hereinafter in connection with the accompanying drawings.

According to the invention, there is provided a golf club requiring an increased ball travelling distance comprising a club head having a mechanical impedance with a primary minimum value in a region of frequency in which the mechanical impedance of a ball to be struck takes a primary minimum value.

The term "mechanical impedace" used herein is introduced for example by the book entitled "Engineering Vibration Research", written by Kenji NAKAGAWA et al, published March 25, 1976, pages 41–42. The mechanical impedance is defined as the ratio of an external force applied to a point of a body over the response speed of another point of the same body when the force is applied. Such mechanical impedance is used in analyzing vibrational characteristics of structures such as buildings, bridges, and so on.

In simpler expression, the mechanical impedance is a parameter which represents the tendency of a body (structure) to resist mechanical vibration imparted thereto from outside. Thus, a body having a lower mechanical impedance is easier to receive mechanical vibration or energy applied thereto.

Actually, the mechanical impedance of a body varies with the frequency of mechanical vibration imparted thereto and exhibits local minimum values at plural points of the varying vibrational frequency. Each of the frequencies at which the mechanical impedance of the body shows a corresponding local minimum value is called "natural frequency".

If the frequency of a vibrational source coincides with a natural frequency of a body, the body will vibrate well because of vibrational resonanse. In other words, the vibrational resonance will cause the energy of the vibrational source to be effectively transmitted to the body. The effect of such vibrational resonance will become most pronounced in case the frequency of the vibrational source becomes equal to the primary (lowest) natural frequency of the body.

In structures (vibrational systems) such as buildings, bridges, and machines, vibrational resonace will cause the structure to vibrate vigorously, resulting in uncontrollable state or destruction of the structure. Thus, it is an established practice to design such a structure with a view to avoiding vibrational resonance with any possible vibrational sources.

Contrary to such a conventional view, the present invention positively utilizes this vibrational resonance. More specifically, the club head according to the invention has a primary natural frequency (primary minimum value in mechanical impedance value) which is substantially or nearly equal to the primary natural frequency (primary minimum value in mechanical impedance) of the golf ball, so that the energy of the club head (club) is most effectively transmitted to the golf ball.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

The present invention will now be described by way of embodiments shown in the accompanying drawings.

As described hereinbefore, the term "mechanical impedance" in this invention is defined as the ratio between the magnitude of force acting upon a point of a body and the response speed of another point of the same body when this force acts. That is to say, when an external force F acts and a response speed V is caused, the mechanical impedance Z is defined as:

$$Z=F/V$$

Golf clubs to which the invention is applied include any wood or iron clubs which are intended to hit a ball over a resonable or considerable distance. Thus, the invention is not applicable to putters which are exclusively designed to provide controlled directivity of a rolled ball and good feeling of putting.

Figure 2:
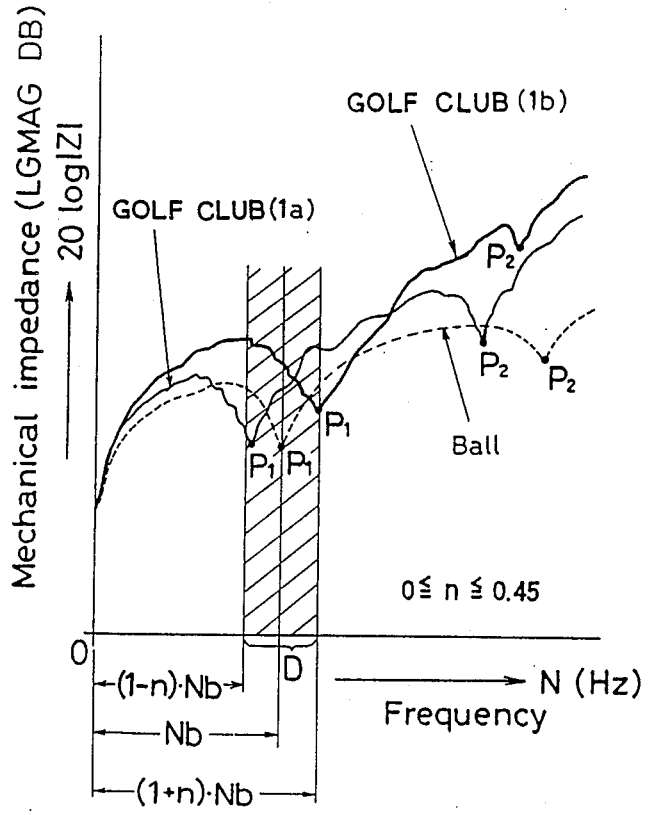
FIG. 2 is also a characteristic-curve diagram similar to FIG. 1 but somewhat schematized for describing the present invention.

In FIG. 2, a diagram is shown in which the frequency N (unit: Hz) of mechanical vibration imparted to the heads of different golf clubs and a ball is indicated on the abcissa while the ordinate indicates the value obtained by multiplying the logarithm of absolute value of mechanical impedance by 20. The diagram therefore shows the manner of variation in mechanical impedances Z of the golf club heads and the ball as the frequency N of mechanical vibration imparted thereto varies. As apparent from the diagram, the mechanical impedances Z of the heads of the golf clubs 1*a* and 1*b* take primary and secondary minimum values respectively at points P1 and P2. Similarly, the mechanical impedance of the struck ball takes primary and secondary values at points P1 and P2, respectively, as indicated in broken line in the diagram. It should be appreciated that tertiary and successive minimum values in the mechanical impedances of the golf club heads and the ball lie outside the diagram.

The frequencies at the points P1, P2, . . . where the primary, secondary, . . . minimum values appear respectively represent so-called primary, secondary, . . . natural frequencies of the golf club heads and the ball. Such natural frequencies are determined by the nature of the mass-spring systems constituted respectively by the golf club heads and the ball as vibratory structures.

A method of measuring the above-mentioned mechanical impedance Z is shown in FIGS. 3A through 3C and FIG. 4.

Figure 3A:
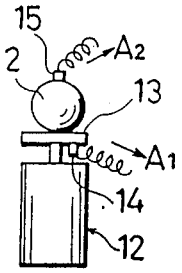
FIGS. 3A through 3C are views each showing a method of vibrating a golf ball, or a golf club, or a golf club head.
Figure 3B:
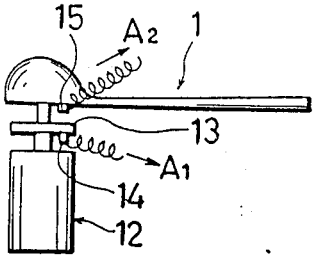
Figure 3C:
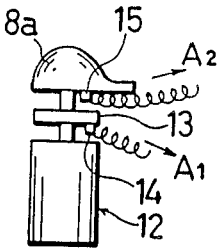

In FIGS. 3A through 3C, there is illustrated an electrically or hydraulically driven vibrator 12 having a sample setting table 13. A ball 2 is fixed to the sample setting table 13 of the vibrator (FIG. 3A), and subjected to mechanical vibration. Similarly, a golf club 1 is fixed at its head 8*a* to the vibrator table 13 (FIG. 3B) to be subjected to mechanical vibration. Alternatively, a separate club head 8*a* alone may be fixed to the vibrator table 13 (FIG. 3C). Obviously, the methods of FIGS. 3B and 3C (golf club 1 as a whole and club head 8*a* alone) give similar results in measurement because, in both cases, it is the club head 8*a* which is directly subjected to mechanical vibration.

A first acceleration detector 14 is secured to the vibrator table 13, whereas a second acceleration detector 15 is secured to the ball 2 or the club head 8*a*. Acceleration A1 of the vibrator table 13, that is, the acceleration imparted from outside to the ball 2 or the club head 8*a*, is fed from the first acceleration detector 14 into a dynamic signal analyzer 17 through a power unit 16. On the other hand, actual acceleration A2 of the ball 2 or the club head 8*a* is supplied from the second acceleration detector 15 into the dynamic singal analyzer 17 through another power unit 18. The ratio between both values of acceleration, that is, transfer function T=A2-/A1, is determined by the dynamic signal analyzer 17 which, on the basis of this ratio, then calculates out mechanical impedance Z=F1/V2 in relation to frequency. The thus obtained mechanical impedance Z is indicated on a display 19 in the form of such a graph as illustrated in FIG. 2.

The following Table 1 shows specific examples of measuring instruments and devices actually used in the measuring method of FIGS. 3A to 3C and 4. In this table, the measuring instruments and devices are identified by reference to their respective suppliers and types. The measuring method utilizing these instruments and devices is advantageous in that it enables accurately detecting the primary minimum value of mechanical impedance Z.

TABLE 1

Instruments and devices used for measurement

| Instrument (Device) | Type | Supplier |
|---|---|---|
| Dynamic signal analyzer 17 | HP-5420A | Yokogawa-Hughlet-Packer (YHP) Co., Ltd. (Japan) |
| Vibrator 12 | | |
| Main body | PET-01 | K. K. Kokusai Kikaishindo Kenkyusho |
| Controller | PET-0A | (IMV CORPORATION) (Japan) |
| Acceleration pickup 14, 15 | 303A03 | PCB |
| Power unit 16, 18 | 480D06 | PCB |

Referring again to FIG. 2, it is now assumed that the mechanical impedance Z of the ball takes a primary minimum value P1 at a frequency Nb. Then, by selecting physical properties such as mass distribution and spring constant, the golf club head is designed to have a primary minimum value P1 of its mechanical impedance Z at a frequency Nc which meets the following formula (1):

$$(1-n)Nb<Nc<(1+n)Nb \quad (1)$$

where: $0<n<0.45$

In FIG. 2, the allowable region of frequency in which the primary minimum value P1 in mechanical impedance of the club head should lie is indicated by a hatched area D. Specifically, the head of one golf club 1*a* is shown to have a primary minimum value P1 in mechanical impedance substantially at the lower limit of this allowable frequency region D, while the head of the other club 1*b* is shown to exhibit a primary minimum value in mechanical impedance substantially at the upper limit of the region D.

To more clearly express the allowable frequency region D, n=0.45, n=0.3, n=0.2, n=0.1, n=0.05 are respectively substituted for the formula (1) as follows:

$$0.55Nb<Nc<1.45Nb \quad (2)$$

$$0.7Nb<Nc<1.3Nb \quad (3)$$

$$0.8Nb<Nc<1.2Nb \quad (4)$$

$$0.9Nb<Nc<1.1Nb \quad (5)$$

$$0.95Nb<Nc<1.05Nb \quad (6)$$

The head of a golf club according to the present invention is fabricated so that the primary minimum value P1 in its mechanical impedance Z will lie in the frequency region satisfying any one of the above formulas (2) to (6). In other words, the golf club head is fabricated in such a way that the mechanical impedance thereof takes a primary minimum value P1 in the frequency region D corresponding to 55%-145%, 70%-130%, 80%-120%, 90%-110%, or 95%-105% of the frequency Nb at which the mechanical impedance Z of the ball takes a primary minimum value P1. While a frequency within 55%-145% of Nb provides a sufficiently large coefficient of restitution, the strongest repulsion of ball can be obtained at a frequency within 95%-105%.

Figure 1:
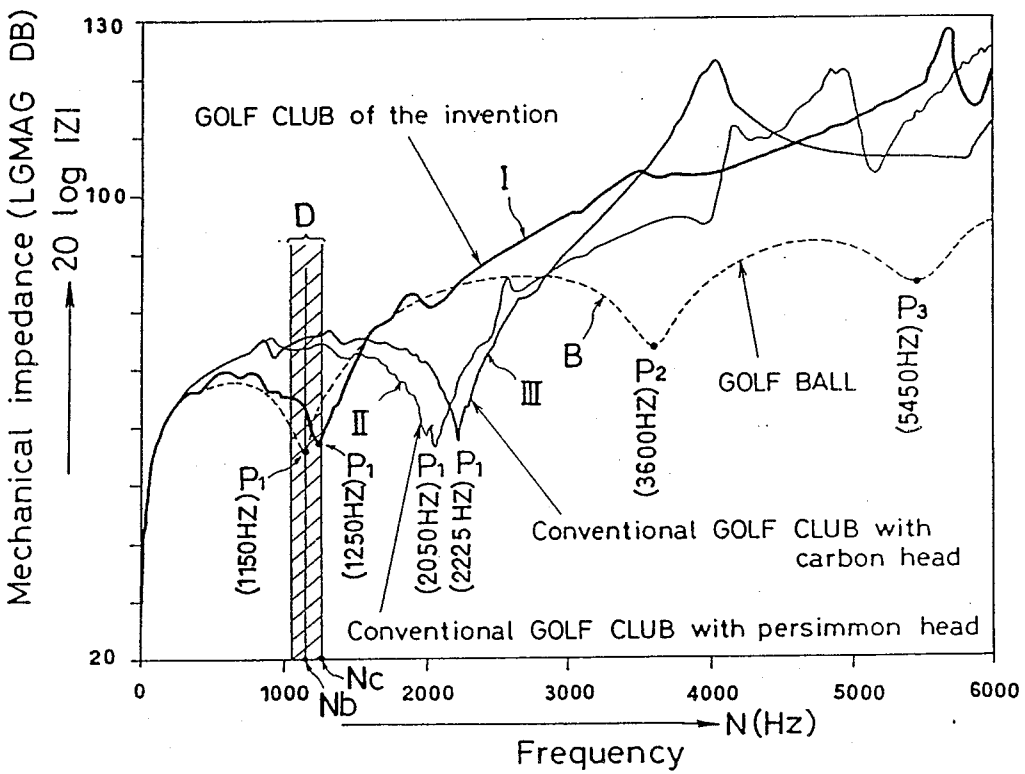
FIG. 1 is a characteristic-curve diagram showing variations in mechanical impedance in relation to vibration frequency, the mechanical impedance being measured by a vibrator method with respect to a golf club head of the invention, two different conventional golf club heads, and a golf ball.

FIG. 1 is a diagram similar to that illustrated in FIG. 2 but more clearly showing comparison in mechanical impedance among a golf club head of the invention, two different conventional golf club heads, and a ball. Measurement was conducted by the previously described vibration method using a vibrator.

In the diagram of FIG. 1, the mechanical impedance of the ball indicated by a broken line B has a primary minimum value P1 at a frequency Nb=1,150 Hz as well as secondary and tertiary minimum values at N=3,600 Hz and N=5,450 Hz, respectively.

At a temperature of 25° C., golf balls available in the market, though variable to a certain extent depending on structure (one-component ball, two-component ball, three-component ball, yarn-wound ball), generally exhibit a primary minimum value P1 in mechanical impedance within a range of frequency Nb which is defined by the following formula (7):

$$600\ \text{Hz}<Nb<1{,}600\ \text{Hz} \quad (7)$$

Thinner solid lines II and III in FIG. 1 show actually measured mechanical impedances of the conventional golf club heads. The golf club head having the mechanical impedance indicated by the line II is a conventional head made of persimmon wood, and exhibits a primary minimum value P1 in mechanical impedance at a frequency Nc of 2,050 Hz. The other club head having the mechanical impedance indicated by the line III is a conventional head made of CFRP, and exhibit a primary minimum value P1 in mechanical impedance at a frequency Nc of 2,225 Hz. It is thus appreciated that the frequency Nc at which the mechanical impedance Z of each conventional club head has the primary value P1 is far outside the region D of frequency at which the mechanical impedance Z of the golf ball takes the primary minimum value P1.

The wood golf club head of the invention, in which mechanical properties such as mass distribution, spring constant, and damping coeffencient are determined according to the above inventive concept, shows a mechanical impedance curve indicated by a thicker solid line I. This mechanical impedance curve has a primary minimum value P1 at a frequency Nc of 1,250 Hz which corresponds to a value obtained by inserting n=0.087 in the formula (1). In other words, the mechanical impedance of the golf club head according to the invention has its primary minimum value P1 located within the region D of frequency which is drawn in FIG. 1 so as to satisfy the formula (5).

Table 2 below shows comparison in performance among the golf club (referred to as "golf club I") having the head of the invention, the conventional persimmon head club (referred to as "golf club II"), and the conventional carbon head club (referred to as "golf club III"). A two-component golf ball (covered with ionomer synthetic resin) was used for the test shot.

TABLE 2

Comparison in performance between a golf club of the invention and conventional golf clubs

| | Component material | | Head speed immediately before shot | Ball speed immediately after shot (initial speed) | Coefficient of restitution | Carry |
|---|---|---|---|---|---|---|
| | Head | Insert | Vh m/sec | Vb m/sec | Vb/Vh | m |
| Club I of the invention | Persimmon | Ionomer resin 8 mm thick | 45.15 | 62.53 | 1.3850 | 192.4 |
| Conventional club II | Persimmon | ABS resin 8 mm thick | 45.16 | 61.31 | 1.3576 | 188.6 |
| Conventional club III | Carbon | CFRP laminated board | 45.08 | 61.08 | 1.3548 | 186.9 |

Table 2 and FIG. 1 reveal the following facts. The coefficient of restitution between a ball and a golf club head increases as the frequency Nc at which the mechanical impedance Z of the club head takes a primary minimum value P1, that is, the natural freqency of the club, approaches the frequency Nb at which the mechanical impedance Z of the ball takes a primary minimum value P1, that is, the natural frequency of the ball, consequently resulting in an increase in travel distance of the hit ball. Specifically, the golf club I of the present invention provides a ball travelling distance about 4 m to 6 m larger than those achieved by the conventional clubs II and III.

Increases of just 1 m in ball travelling distance are very important to golfers. Therefore, the golf club of the present invention capable of achieving an increase of about 4 m to 6 m in ball travelling distance provides a significant advantage.

The conventional golf club heads have a primary minimum value P1 in mechanical impedance Z at a frequency of 2,000 Hz or more. However, the club head according to the invention is fabricated so that a primary minimum value P1 in mechanical impedance will appear in a relatively low frequency region of 600 Hz–1,600 Hz which corresponds to the primary natural frequencies of various kinds of golf balls.

Despite such a difference in mechanical impedance, the golf club head according to the invention may remain substantially equal in mass distribution to a conventional club. To explain this, reference is now made to FIGS. 6 and 7.

Figure 6:
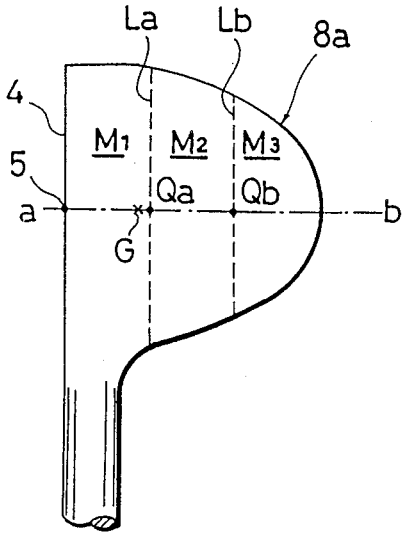
FIG. 6 is a view of a club head for illustrating the mass distribution thereof.
Figure 7:
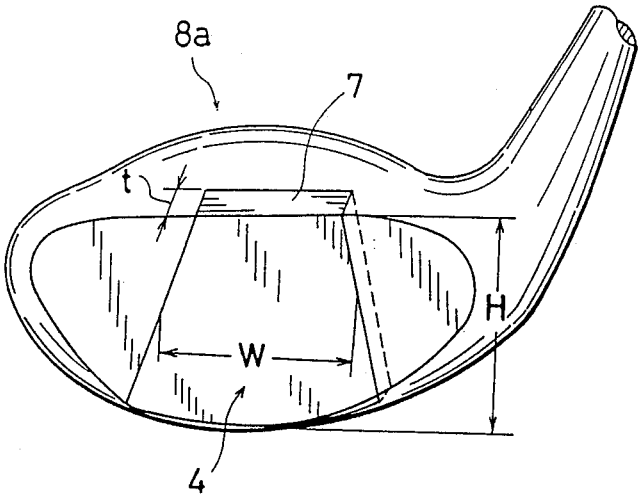
FIG. 7 is a perspective view for illustrating the structure of a club head according to the invention.

FIG. 6 shows a club head 8*a* according to the invention. A line a-b is drawn which passes through the center 5 of the ball striking face 4 and extends perpendicularly with respect to the face 4. The club head 8*a* is divided into three parts M1, M2, and M3 by two planes La, Lb which perpendicularly intersects the line a-b at two points Qa and Qb dividing the line a-b into three equal segments. The center G of gravity of the club head 8*a* lies at a position near the plane La, such a mass distribution being substantially equal to that of a conventional club head. More specifically, the ratio of mass between the three divided parts M1, M2, and M3 of the head 8*a* is represented as follows:

M1:M2:M3=5:3:2

To enable the above mass distribution while satisfying the requirements for mechanical impedance, the ball striking face 4 of the head 8*a* may be provided with an insert 7 which is markedly low in spring constant k than conventional inserts. In the golf club I of the invention shown in Table 2 and FIG. 1, an insert 7 made of ionomer resin has been used which has a thickness t=8 mm, width w=40 mm, height H=40 mm, and spring constant k=11,000 kg/cm when compression is exerted on an area of 20 mm diameter.

In this way, the insert 7 is made of a material which is significantly lower in spring constant k than conventional ABS plastics, laminated boards of carbon-fiber-reinforced plastics (CFRP), or metallic plates such as aluminum. As a result, the the golf club or the head 8*a* will have a primary minimum value p1 in mechanical impedance or a primary natural frequency Nc (resonance frequency) within a frequency region of 600 Hz–1,600 Hz. Nevertheless, the golf club of the invention incorporating such an insert requires no modification in mass distribution and configuration from a conventional golf club.

An insert for the ball striking face of the club head may be made of various materials and provided in various thicknesses. For example, an insert made of ionomer resin may have a thickness of 8 mm–40 mm to provide a spring constant k of 7,000 kg/cm–16,000 kg/cm. A club head incorporating such an insert will show a primary minimum value in mechanical impedance at a frequency Nc of 600 Hz–1,600 Hz. This club head will provide an increase of 1.47%–4% in coefficient of restitution over a conventional club head incorporating an ABS resin insert 8 mm in thickness. Naturally, an increased coefficient of restitution results in an increased ball travelling distance.

Table 3 below shows the results of tests conducted for inserts formed of various materials in various thicknesses t. Each insert was incorporated in a persimmon wood head for the test shot.

TABLE 3

Insert materials and thicknesses applicable to the invention

| Insert thickness / Insert Material | 8 mm | 12 mm | 16 mm | 18 mm | 20 mm | 24 mm | 26 mm | Product name and Supplier |
|---|---|---|---|---|---|---|---|---|
| Ionomer resin | C = 0.0107<br>Nc = 1400<br>k = 16000 | C = 0.0181<br>Nc = 1260<br>k = 12800 | C = 0.0260<br>Nc = 1150<br>k = 11000 | C = 0.0288<br>Nc = 1100<br>k = 9800 | C = 0.0404<br>Nc = 1050<br>k = 8900 | C = 0.0262<br>Nc = 1030<br>k = 8600 | C = 0.0234<br>Nc = 1020<br>k = 8400 | "Surlyn" DuPont |
| Nylon-12 | C = 0.0066<br>Nc = 1500<br>k = 18200 | o | o | o | o | o | o | "Grilux N1200" Dainippon Ink and Chemicals, Inc. |
| Mixture of Ionomer | C = 0.0092 | C = 0.0133 | C = 0.0196 | C = 0.0259 | o | o | o | "Surlyn" |

TABLE 3-continued

| Insert thickness / Insert Material | 8 mm | 12 mm | 16 mm | 18 mm | 20 mm | 24 mm | 26 mm | Product name and Supplier |
|---|---|---|---|---|---|---|---|---|
| | Insert materials and thicknesses applicable to the invention | | | | | | | |
| and Nylon-12 (mixing weigh ratio = 85:15) | Nc = 1450 k = 17000 | Nc = 1280 k = 13100 | Nc = 1220 k = 12000 | Nc = 1150 k = 11000 | | | | DuPont "Grilux N1200" Dainippon Ink and Chemicals, Inc. |
| Urethane | C = 0.0087 Nc = 1400 k = ? | o | o | o | o | o | o | "Takenate L-2790" Takeda Chemical Industries, Ltd. |
| Polyester elastomer | o | o | o | C = 0.0200 Nc = 1100 k = 9800 | o | o | o | "Hytrel" DuPont |
| ABS resin | x | x | x | C = 0.0150 Nc = 1660 k = 22000 | o | o | o | "Sevian" Daicel Chemical Industries, Ltd. |

Explanation of symbols:
C: Increase in coefficient of restitution over conventional club head incorporating ABS resin insert (thickness = 8 mm, Nc = 2,020 Hz, K = 33,000 kg/cm)
Nc: Frequency (Hz) at which club head shows primary minimum value in mechanical impedance
k: Spring constant (k/cm) of club head when compression is exerted on area of 20 mm diameter
o: Judgement as applicable to the invention
x: Judgement as non-applicable to the invention From Table 3, it is appreciated that nylon-12 usable as an insert material. For example, a club head with a nylon-12 insert of 8 mm in thickness has a spring constant of 18,200 kg/cm, and exhibits a primary minimum value in mechanical impedance at a frequency Nc of 1,500 Hz, resulting in an increase of 0.66% in coefficient of restitution. It is expected that a thicker nylon-12 insert will further increase the coefficient of restitution.

A mixture (mixing ratio=85:15) of ionomer and nylon-12 is also usable as an insert material. A club head incorporating an insert formed of this mixture material with a thickness of 8 mm–18 mm has a spring constant of 11,000 kg/cm–17,000 kg/cm and exhibits a primary minimum value in mechanical impedance at a frequency Nc of 1,150 Hz–1,450 Hz. This club head provides an increase of 0.92%–2.59% in coefficient of restitution over a conventional club head incorporating an ABS resin insert of 8 mm in thickness, thereby ensuring an increased ball travelling distance.

Table 3 further shows that urethane and polyester elastomer are preferable insert materials.

Figure 12:
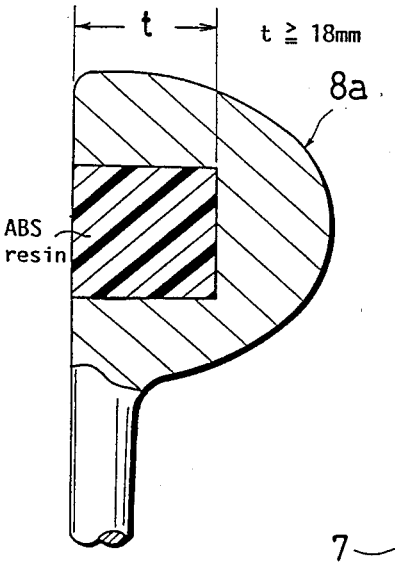
FIG. 12 is a view in section showing an insert type club head embodying the invention.

Surprisingly, ABS resin becomes usable as an insert material if the thickness t of the insert is made far larger than is conventionally considered normal (see FIG. 12). At a thickness of 18 mm for example, the ABS resin insert, when incorporated in a club head, has a spring constant k of 22,000 kg/cm and shows a primary minimum value in mechanical impedance at a frequency Nc of 1,660 Hz, providing an increase of 1.5% in coefficient of restitution. Though the value of 1,660 Hz for the primary minimum value of the mechanical impedance is slightly outside the frequency region of 600 Hz–1,600 Hz quated hereinbefore, the 18 mm thick ABS resin insert is still acceptable in view of 1.5% increase in coefficient of restitution. Naturally, a thicker ABS resin will produce a better result.

Other insert materials presently considered recommendable include monomer casting nylon, polyethylene terephthalate, polycarbonate, polyethylene, methacrylic resin, vinyl chloride resin, polyacetal, polystyrene, polyphenylene oxide, polypropylene, polybutylene terephthalate, vinyl ester, unsaturated polyester, aromatic polyester, melamine resin, urea resin, epoxy resin, ketone resin, and polyvinyl alcohol.

Applicability of various materials, particularly ABS resin, as a club head insert material supports the justifiability of the present invention which requires exact or approximate coincidence in primary minimum value of mechanical impedance between the club head and the ball to provide an increased coefficient of restitution. The restitution property alone of a particular insert material can not increase the coefficient of restitution between the club head and the ball. It is, therefore, necessary to determine the structure (mass distribution etc.) of the club head in consideration of the material or materials from which it is made.

Figure 13:
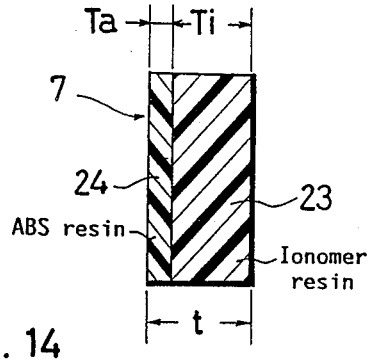
FIG. 13 is a view in section showing another example of insert usable in a golf club head of the invention.

FIG. 13 illustrates a laminated insert to be incorporated in a golf club according to the invention. More specifically, the laminated insert designated by reference numeral 7 includes a base layer 23 of ionomer resin having a thickness Ti, and a face layer 24 of ABS resin having a thickness Ta. This insert 7 may be mounted to a wood head so that the ABS layer 24 becomes flush with the ball striking face 4 of the head (see FIG. 7).

Table 4 below shows the results obtained for the laminated insert 7 of FIG. 13 by varying the thickness Ti of the ionomer resin layer 23 and the thickness Ta of the ABS resin layer 24.

TABLE 4

| Overall thickness of insert t mm | Layer thickness ABS Ta mm | Layer thickness Ionomer Ti mm | * Nc | ** C |
|---|---|---|---|---|
| | Improvement in performance obtainable by laminated insert of FIG. 13 | | | |
| 20 | 4 | 16 | 1,400 Hz | +1.46% |
| 19 | 3 | 16 | 1,300 Hz | +1.50% |
| 18 | 2 | 16 | 1,200 Hz | +1.60% |
| 12 | 4 | 8 | 1,600 Hz | +0.82% |
| 11 | 3 | 8 | 1,550 Hz | +0.59% |
| 10 | 2 | 8 | 1,500 Hz | +0.63% |

*Nc: Frequency at which club head shows primary minimum value in mechanical impedance
**C: Increase in coefficient of restitution over conventional club head incorporating ABS resin insert (thickness t = 8 mm, Nc = 2.020 Hz, spring constant k = 33,000 kg/cm)

From Table 4, it is observed that the laminated insert incorporated in a persimmon wood club head shows a primary minimum value in mechanical impedance at a frequency Nc of 1,200 Hz–1,600 Hz, providing an increase of 0.59%–1.60% in coefficient of restitution. In this case, the thickness Ti of the ionomer resin layer 23 varies within a range of 8 mm–16 mm, whereas the thickness Ta of the ABS resin layer 24 varies within a range to 2 mm–4 mm. Of course, an allowable thickness range is much broader.

Figure 11A:
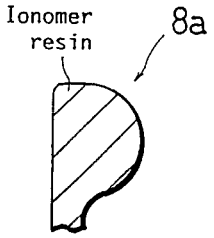
FIGS. 11A through 11C are views in section each showing a non-insert type club head embodying the invention.
Figure 11B:
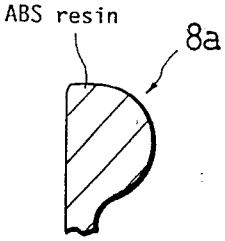
Figure 11C:
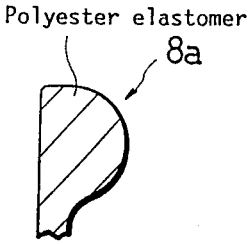

Instead of using an insert for the ball striking face of a club head 8*a*, the head in its entirety may be made of ionomer resin, ABS resin, or polyester elastomer, as illustrated in FIGS. 11A, 11B, or 11C, respectively. Such a club head 8*a* will also have a primary minimum value in mechanical impedance in a region of frequency in which a golf ball has a primary minimum value in mechanical impedance. Specifically, the single piece club head 8*a* will exhibit a primary minimum value in mechanical impedance at a frequency of 600 Hz–1,600 Hz.

Table 5 below shows the performance improvement of the integral club head illustrated in each of FIGS. 11A to 11C over a conventional persimmon wood head incorporating an ABS resin insert of 8 mm in thickness.

TABLE 5

| Improvement in performance obtainable by club heads of FIGS. 11A to 11C | | | |
|---|---|---|---|
| Club head material<br>Product name<br>Supplier | *<br>Nc | **<br>C | Corresponding<br>FIG. |
| Ionomer resin<br>"Surlyn"<br>DuPont | 1,100 Hz | +3.5% | FIG. 11A |
| ABS resin<br>"Sevian"<br>Daicel Chemical Industries, Ltd. | 1,300 Hz | +2.0% | FIG. 11B |
| Polyester elastomer<br>"Hytrel"<br>DuPont | 1,100 Hz | +2.5% | FIG. 11C |

*Nc: Frequency at which club head shows primary minimum value in mechanical impedance

**C: Increase in coefficient of restitution over conventional club head incorporating ABS resin insert (thickness t = 8 mm, Nc = 2,020 Hz, spring constant k = 33,000 kg/cm)

Table 5 reveals that the ionomer resin club head (FIG. 11A) provides an increase of 3.5% in coefficient of restitution over the conventional wood head. Similarly, the ABS resin head and the polyester elastomer head produce an increase of 2.0% and 2.5%, respectively.

Figure 14:
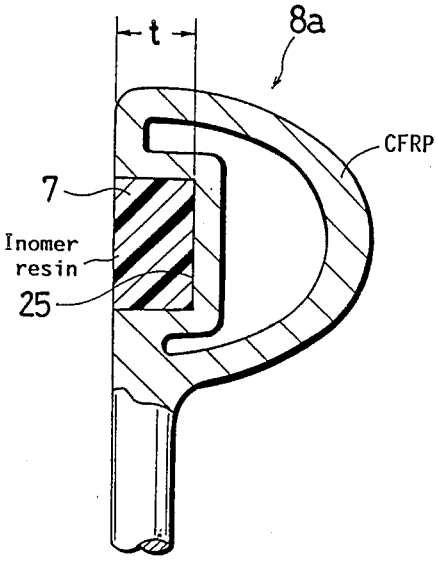
FIG. 14 is a view in section showing a further insert type club head embodying the invention.

FIG. 14 illustrates a further club head 8*a* according to the invention. This club head 8*a*, which is made of CFRP, is hollow and formed on its ball striking face 4 with a mounting recess 25. An ionomer resin insert 7 of 18 mm in thickness t is mounted in the recess 25 as by adhesive bonding. The following data indicate performance improvement of the hollow club head over a conventional persimmon wood head incorporating an ABS resin insert of 8 mm in thickness.

Spring constant of club head: k=11,000 kg/cm

Frequency at which primary minimum value in mechanical impedance is observed: Nc=1,100 Hz Increase in coefficient of restitution: 2%

FIGS. 9A, 9B, 9C and 10 shows another method of measuring the mechanical impedance Z. A ball 2 (FIG. 9A), or a golf club 1 (FIG. 9B), or a separate golf club head 8*a* (FIG. 9C) is suspended by a thin wire 21. The ball 2 or the head 8*a* (of the club 1 in FIG. 9B) is hit by an impact hammer 20. A force detector 22 is attached to the impact part 20*a* of the impact hammer 20, whereas an acceleration detector 15 is attached to the ball 2 or the club head 8*a*.

When the ball 2 (FIG. 9A) or the club head 8*a* (FIGS. 9B and 9C) is struck by the impact hammer 20 as indicated by an arrow G, a force F1 applied to the ball 2 or the head 8*a* by the hammer 20 is detected by the force detector 22. This force is fed into a dynamic signal analyzer 16 through a power unit 16. On the other hand, the acceleration detector 15 picks up an actual acceleration A2 of the ball 2 or the club head 8*a* and supplies it into the analyzer 17 through another power unit 18. The ratio between the acceleration A2 and the external force F1, namely a transfer function T=A2/F1, is determined by the dynamic signal analyzer 17 which, on the basis of this ratio or transfer function, then calculates the mechanical impedance Z=F1/V2 in relation to frequency. The thus obtained mechanical impedance is indicated at a display 19 in the form of a mechanical impedance curve.

The impact hammer 20 used in the above impact method is Type 208A03 supplied by PCB Corporation. The remaining instruments and devices used for measurment are identical to those listed in Table 1.

Measurement by the above impact method was conducted with respect to a golf ball, two different golf club heads according to the invention, and two different conventional golf club heads. The results of such measurement are indicated in FIG. 8 showing a diagram.

Figure 8:
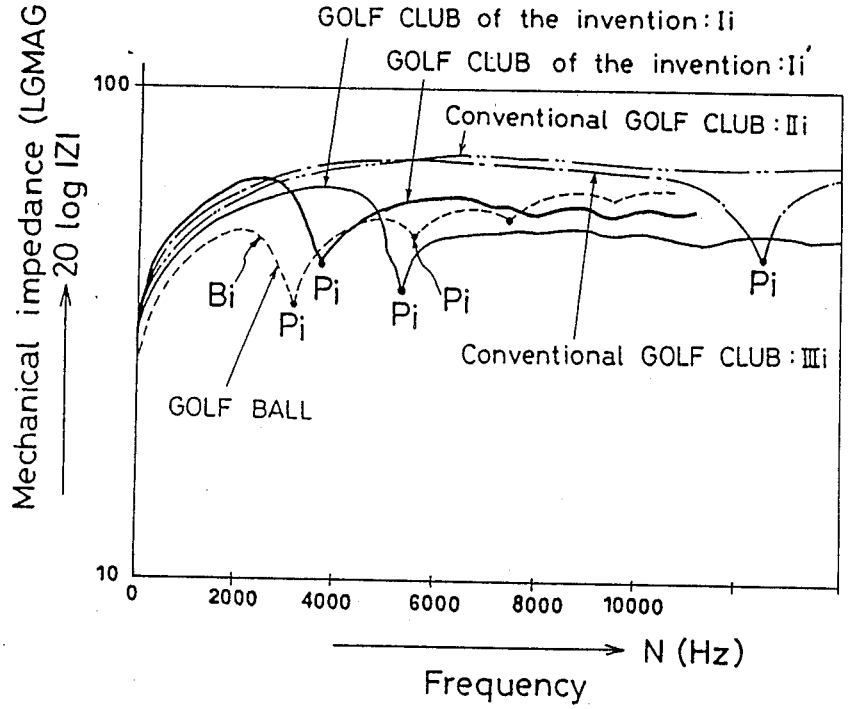
FIG. 8 is a characteristic-curve diagram showing variations in mechanical impedance in relation to vibration frequency, the mechanical impedance being measured by an impact method with respect to two different golf club heads of the invention, two different conventional golf club heads, and a ball.
Figure 9A:
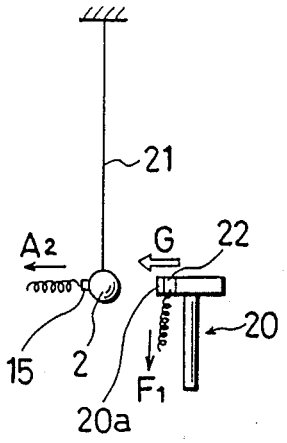
FIGS. 9A through 9C are schematic view each showing a method of impacting a golf ball, or a golf club, or a club head.
Figure 9B:
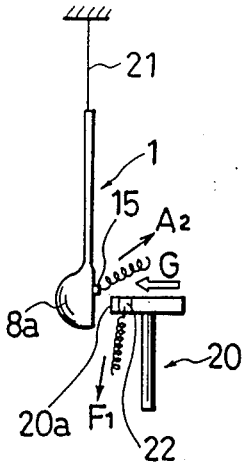
Figure 9C:
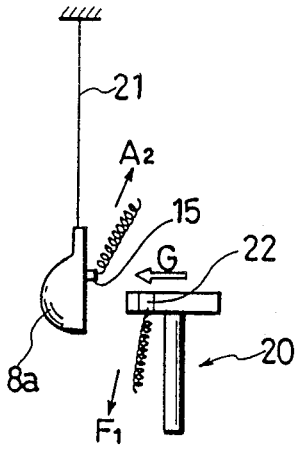
Figure 10:
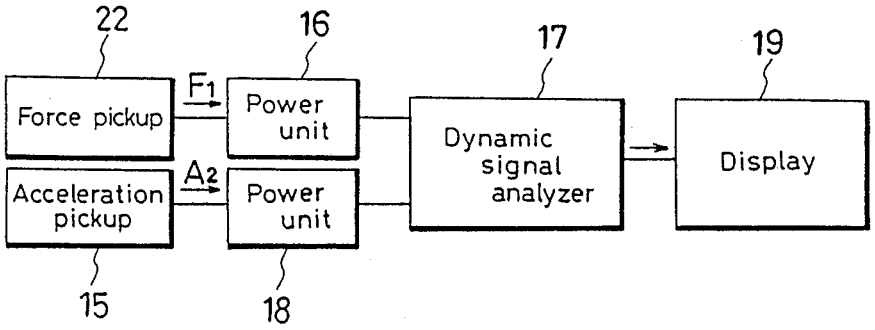
FIG. 10 is a block diagram showing an example of apparatus for measuring the mechanical impedance of each article impacted according to the impact method of FIGS. 9A to 9C.

A brief comparison of FIG. 8 with FIG. 1 reveals that the mechanical impedance curves obtained by the impact method look considerably different in overall configuration from those obtained by the vibrator method.

In FIG. 8, the mechanical impedance curve Bi (indicated by a broken line) for the golf ball has a plurality of local minimum values Pi in a frequency region of 0 to 10,000 Hz. The primary minimum value Pi is observe at a frequency N of about 3,000 Hz–4,000 Hz. This frequency corresponds to the frequency at which the mechanical impedance obtained for a ball by the vibrator method has a secondary minimum value (see FIG. 1).

The mechanical impedance curves for the conventional wood club heads are indicated by two dashed lines IIi and IIIi in FIG. 8. As readily appreciated, the curves IIi and IIIi have no distinct minimum values in a frequency region of 0–10,000 Hz.

The mechanical impedance curves for the wood club heads according to the invention are represented by two solid lines Ii and Ii' in FIG. 8. By properly selecting mass distritution, spring constant, and damping coefficient, each club head of the invention is designed to have a local minimum value Pi in a frequency region ranging from 1,500 to 8,000 Hz, preferably from 2,000 to 6,000 Hz. Particularly, in view of the minimum impedance value of the golf ball at a frequency of about 3,000 to 4,000 Hz when measured by the impact method, it is best to fabricate a wood club head so that a minimum value Pi appears in a frequency region of 2,000 to 4,500 Hz.

Table 6 below shows comparison in performance between the club heads (corresponding to curves Ii and Ii' in FIG. 8) of the invention and the conventional club heads (corresponding to curves IIi and IIIi). The ball used for the test shot was a two-component ball covered with ionomer resin, the mechanical impedance curve of which being also shown in FIG. 8 (see curve Bi).

TABLE 6

| Comparison in performance between golf clubs of the invention and conventional golf clubs | | | | | |
|---|---|---|---|---|---|
| | Component material | | Head speed immediately before shot | Ball speed immediately after shot (initial speed) | Coefficient of restitution |
| | Head | Insert | Vh m/sec | Vb m/sec | Vb/Vh |
| Club Ii of the Invention | Carbon | Ionomer resin, Spring constant: 10,000 kg/cm | 45.18 | 62.50 | 1.3862 |
| Club Ii' of the invention | Carbon | Ionomer resin, Spring constant: 8,000 kg/cm | 45.24 | 63.86 | 1.4116 |
| Conventional club II | Persimmon | ABS resin, Spring constant: 40,000 kg/cm | 45.20 | 61.81 | 1.3675 |
| Conventional club III | Carbon | CFRP ply board, Spring constant: 80,000 kg/cm | 45.25 | 61.87 | 1.3673 |

Note:
The thickness of each insert was 8 mm, and the spring constant thereof was based on compression exerted on an area of 25 mm diameter.

The following can be understood from Table 6 above and FIG. 8. The golf clubs of the invention showing respective minimum values at frequencies of 5,250 Hz and 3,800 Hz (as measured by the impact method) are far larger in coefficient of restitution than the conventional club heads exhibiting no minimum value in a frequency region of 0 to 10,000 Hz. Therefore, the golf club heads of the invention will provide an increase of 2 to 8 m in ball travelling distance over the conventional club heads.

Figure 15A:
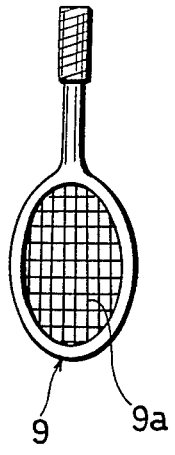
FIGS. 15A to 15C are front views showing various ball striking instruments other than a golf club.
Figure 15B:
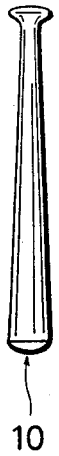
Figure 15C:
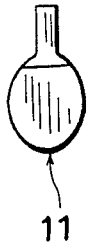

The present invention, though advantageously applicable to golf clubs, may also be applied to other ball striking instruments. As examples of such other ball striking instruments, a tennis racket 9, a baseball bat 10 and a table tennis racket 11 are illustrated in FIGS. 15A to 15C, respectively. Naturally, the tennis racket 9, the baseball bat 10, or the table tennis racket 11 is required to have a primary minimum value (corresponding to primary natural frequency) in mechanical impedance which satisfies the formula (1) (or any one of the formulas (2) to (6)) so as to provide an increased coefficient of restitution in relation to a ball.

Figure 4:
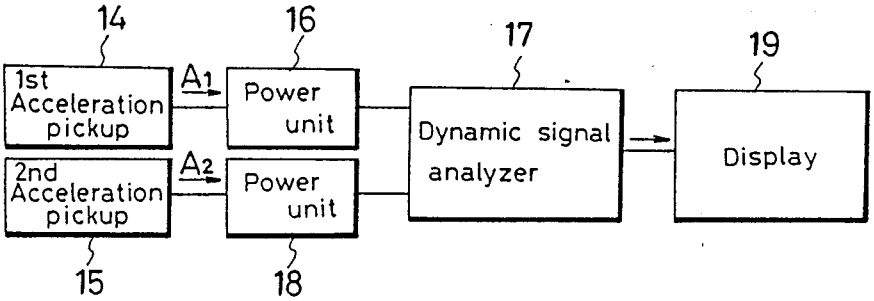
FIG. 4 is a block diagram showing an example of apparatus for measuring the mechanical impedance of each article vibrated according to the vibrator method of FIGS. 3A to 3C.
Figure 5:
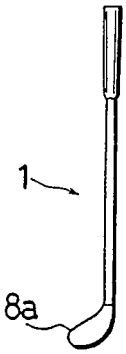
FIG. 5 is a front view of a golf club.

As a result of repeated tests conducted in the same manner as shown in FIGS. 3A and 4, it has been found that balls for tennis or baseball exhibit a primary minimum value in mechanical impedance at a frequency of 110 to 500 Hz (100 to 500 Hz for table tennis balls). Therefore, the tennis racket or the baseball bat should be preferably designed to have a primary minimum value (corresponding to primary natural frequency) in mechanical impedance at a frequency of 110 to 500 Hz (100 to 500 Hz for the table tennis racket) by properly adjusting various parameters such as mass distribution and spring constant.

Figure 16A:
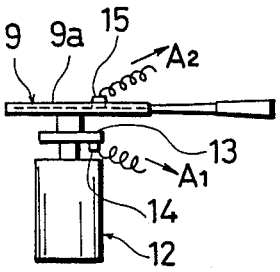
FIGS. 16A to 16C are views showing a method of vibrating the instruments of FIGS. 15A to 15C.
Figure 16B:
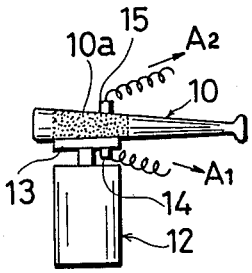
Figure 16C:
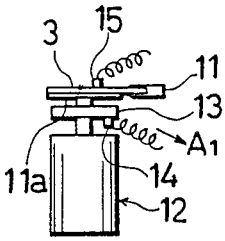

The mechanical impedance of the tennis racket 9, the baseball bat 10, or the table tennis racket 11 can be measured in substantially the same manner as already described in connection with the golf club. More specifically, the ball striking part 9*a*, 10*a*, or 11*a* of the tennis racket 9, the baseball bat 10, or the table tennis racket 11 is fixed to the sample setting table 13 of vibrator 12 to receive mechanical vibration, as illustrated in FIG. 16A or 16B. The vibrational force A1 applied to the racket 9, 11 or the bat 10 and the actual acceleration A2 thereof are detected by the respective pickups 14, 15 for calculation of mechanical impedace in the measuring unit illustrated in FIG. 4.

The invention being thus described, it will be obvious that the same may be varied in many ways. Such variations are not to be regarded as a departure from the spirit and scope of the invention, and all such modifications as would be obvious to those skilled in the art are intended to be included within the scope of the following claims.

We claim:

1. A golf club for providing an increased ball traveling distance comprising a club head having a mechanical impedance with a primary minimum value within a frequency range of 600 Hz to 1,600 Hz when measured by a vibrator method, said club head further having a spring constant of 7,000 kg/cm to 22,000 kg/cm.

2. The golf club as defined in claim 1, wherein said club head has a ball striking face which is provided with a resinous insert having a thickness of not less than 8 mm.

3. The golf club as defined in claim 2, wherein said insert is made of ionomer resin and has a thickness of up to 40 mm.

4. The golf club as defined in claim 3, wherein said club head is hollow and made of carbon-fiber-reinforced plastics.

5. The golf club as defined in claim 2, wherein said insert is made of nylon-12.

6. The golf club as defined in claim 2, wherein said insert is made of a mixture containing ionomer resin and nylon-12.

7. The golf club as defined in claim 2, wherein said insert is made of urethane.

8. The golf club as defined in claim 2, wherein said insert is made of polyester elastomer.

9. The golf club as defined in claim 2, wherein said insert is made of ABS resin and has a thickness of not less than 18 mm.

10. The golf club as defined in claim 2, wherein said insert comprises two layers made of different materials and laminated one on the other.

11. The golf club as defined in claim 10, wherein said insert has a thickness of not less than 10 mm, one of said two layers being a base layer made of ionomer resin.

12. The golf club as defined in claim 1, wherein the entirety of said club head is made of ionomer resin.

13. The golf club as defined in claim 1, wherein the entirety of said club head is made of ABS resin.

14. The golf club as defined in claim 1, wherein the entirety of said club head is made of polyester elastomer.

15. The golf club as defined in claim 1, wherein said club head has a ball striking face which is provided with an ionomer resin insert having a thickness of 8 mm to 40 mm.

16. The golf club as defined in claim 1, wherein said club head has a ball striking face which is provided with an insert having a thickness of 8 mm to 18 mm, said insert being made of a mixture containing ionomer resin and nylon-12.

17. A golf club for providing an increased ball travelling distance comprising a club head having a primary natural frequency within a range of 600 Hz to 1,600 Hz.

18. A method for designing a golf club with respect to a ball to increase ball travelling distance comprising the steps of:

measuring mechanical impedance of the ball relative to varying frequency of mechanical vibration imparted thereto to determine a primary minimum value in the mechanical impedance of said ball;

measuring mechanical impedance of a head of the golf club relative to varying frequency of mechanical vibration imparted thereto to determine a primary minimum value in the mechanical impedance of the club head; and designing said club head with the frequency at which said club head takes the primary minimum value of mechanical impedance to be within a range of 55%–145% of the frequency at which said ball takes the primary minimum value of mechanical impedance.

* * * * *